US006926080B2

(12) United States Patent
Khomynets et al.

(10) Patent No.: US 6,926,080 B2
(45) Date of Patent: Aug. 9, 2005

(54) OPERATION METHOD OF AN OIL WELL PUMPING UNIT FOR WELL DEVELOPMENT AND DEVICE FOR PERFORMING SAID OPERATION METHOD

(76) Inventors: Zinoviy Dmitrievich Khomynets, d. 33, ul. Vilshanetskaya, Tismenitsa, obl.Ivano-Frankovskaya (UA), 77400; Vladimir Petrovich Stenin, kv. 88, d.10, ul. Kulakova, Moscow (RU), 123592

( * ) Notice: Subject to any disclaimer, the term of this patent is extended or adjusted under 35 U.S.C. 154(b) by 115 days.

(21) Appl. No.: 10/296,676

(22) PCT Filed: May 22, 2001

(86) PCT No.: PCT/RU01/00201

§ 371 (c)(1),
(2), (4) Date: Nov. 26, 2002

(87) PCT Pub. No.: WO01/92727

PCT Pub. Date: Dec. 6, 2001

(65) Prior Publication Data

US 2004/0223853 A1 Nov. 11, 2004

(30) Foreign Application Priority Data

May 31, 2000 (RU) ..... 2000113770
Jul. 10, 2000 (RU) ..... 2000117928

(51) Int. Cl.[7] ..... E21B 47/00

(52) U.S. Cl. ..... 166/250.07; 166/55.1; 166/105; 166/297; 166/372

(58) Field of Search ..... 166/297, 370, 166/372, 250.07, 105, 55.1

(56) References Cited

U.S. PATENT DOCUMENTS 5,372,190 A * 12/1994 Coleman ..... 166/68
5,374,163 A * 12/1994 Jaikaran ..... 417/172
5,971,069 A * 10/1999 Stoy et al. ..... 166/250.03
6,250,384 B1 * 6/2001 Beauquin ..... 166/105.5
6,497,287 B1 * 12/2002 Podio et al. ..... 166/370
6,685,439 B1 * 2/2004 Harrell et al. ..... 166/372
6,755,249 B2 * 6/2004 Robison et al. ..... 166/262

* cited by examiner

*Primary Examiner*—Hoang Dang
(74) *Attorney, Agent, or Firm*—Dellett & Walters

(57) ABSTRACT

The invention relates to pumping units for extraction oil from oil wells comprising, all of them being installed on the piping string, a packer, a back pressure valve, a jet pump having the active nozzle, the mixing chamber, the diffuser and the central channel for supplying a passive medium, and a seal assembly. The back pressure valve is installed below the seal assembly, and a geophysical instrument is installed on the well-logging cable going through the seal assembly. The unit further comprises a filter and a perforator. The geophysical instrument is installed above the back pressure valve and below the jet pump, and the filter and the perforator are installed below the back pressure valve.

2 Claims, 3 Drawing Sheets

OPERATION METHOD OF AN OIL WELL PUMPING UNIT FOR WELL DEVELOPMENT AND DEVICE FOR PERFORMING SAID OPERATION METHOD

FIELD OF INVENTION

This invention relates to the field of pumping units, and, in particular, to pumping units for extraction oil from oil wells.

PRIOR ART

Known in the art is a method of operating a well pumping unit, comprising the installation of a jet pump onto the production string in the well, the placement of a geophysical instrument below the said jet pump in the production string, and pumping of the extracted fluid out of the well, while conducting fluid treatment in the well with the use of the said geophysical instrument (RU 2143597 C1).

The said method enables to pump different fluids, e.g., oil, out of wells, while simultaneously studying the effective formation and the extracted fluid.

However, the said known method does not enable to perform works for intensifying oil (hydrocarbons) production in wells through employing the more advanced secondary opening-up of productive formations, which narrows the field of its application.

Also known in the art is an oil well jet pumping unit, comprising a jet pump installed on the production string in the well and a geophysical instrument placed in the production string below the said jet pump (RU 2059891 C1).

The said jet pumping unit enables to pump different extracted fluids out of the well with the simultaneous treatment of the extracted fluid and the well formation zone.

However, the said known unit does not enable to prevent the formation from being repeatedly damaged by the working medium just after stopping the operation of the pumping unit, which narrows the field of its application.

The closest, as to its technical essence and the achievable result, to this invention is a method of operating an oil well pumping unit, comprising the installation of a jet pump onto the production string and the installation of a perforator below the said jet pump, the installation of a packer into the production string annular space, the supply an ejecting medium through the production string to the nozzle of the said jet pump, the pumping of the fluid out of the zone below the said packer with the said jet pump and the formation drainage through firing the said perforator (SU 1146416 C1).

The said method of operating the well pumping unit enables to perform works on intensifying the fluid extraction out of the well through firing (shooting) the perforator with the subsequent pumping the fluid out of the well with a jet pump.

However, the said known work method does not enable to optimize the works on intensifying the process of extracting different fluids out of wells, which results in an incomplete utilization of the well potential.

The closest, as to its technical essence and the achievable result, to this invention is an oil well jet pumping unit, comprising, all of them being installed on the piping string, a packer; a back pressure valve; a jet pump having an active nozzle, a mixing chamber, a diffuser and a central channel for supplying a passive medium; and a seal assembly (a gate), the said back pressure valve being installed below the said seal assembly and a geophysical instrument being installed on a well-logging cable going through the said seal assembly (RU 2121610 C1).

The said unit enables to perform work on intensifying the fluid extraction out of wells by influencing the formation with the said geophysical instrument and the subsequent pumping the fluid out of the well with a jet pump.

However, the said known unit does not enable to optimize the works on intensifying the process of extracting different fluids out of wells and perform works on effectively punching the formation under the well zone where the pumping equipment is installed, which results in an incomplete utilization of the well potential.

DESCRIPTION OF INVENTION

The objective of this invention is to intensify the action on the well formation zone due to optimizing various influence factors in subpressure wells, and, owing to it, to stimulate the fluid production during the well development after drilling or during a well-workover operation.

The objective in respect of method can be solved through employing a work method of an oil well pumping unit, where the said method comprises the installation of a jet pump onto the production string and the installation of a perforator below the said jet pump; the installation of a packer in the production string annular space, the supply of an ejecting medium through the production string to the nozzle of the said jet pump, the pumping of the fluid from the well area under the said packer and the formation drainage performed by firing the said perforator; and, in employing the method according to this invention, a geophysical instrument is installed below a jet pump after the installation of the latter in the production string, a back pressure valve and a filter are installed below the said geophysical instrument; after that an ejecting medium is supplied to the nozzle of the said jet pump, the pressure drawdown is measured with the use of the said geophysical instrument, and after reaching a preset stable pressure drawdown a signal to shoot the said perforator is sent from the said geophysical instrument, the formation fluid being continuously pumped out by the said jet pump through the said filter and the said back pressure valve; and, after a stable flow of the fluid extracted from the well is established, the supply of the said ejecting medium to the jet pump is stopped, the said geophysical instrument is removed, the said jet pump is disconnected from the said valve and is raised to the surface; after that a production pump is installed above the said back pressure valve on the production string, and the said production pump is used for pumping the extracted fluid out of the well.

The objective in respect of device can be solved through the use of a oil well jet pumping unit, comprising, all of them being installed on the piping string, a packer, a back pressure valve, a jet pump having an active nozzle, a mixing chamber, a diffuser and a central channel for supplying a passive medium, a seal assembly (a gate), the said back pressure valve being installed below the said seal assembly and a geophysical instrument being installed on a well-logging cable going through the said seal assembly, and the said oil well jet pumping unit according to this invention further comprises a filter and a perforator, the said geophysical instrument being installed above the said back pressure valve and below the said jet pump, and the said filter and the said perforator being installed below the said back pressure valve, the said piping string is made with a connecting/disconnecting insert located above the said back pressure valve, the said geophysical instrument is equipped with a physical (e.g., acoustic, electromagnetic, etc.) field source for initiating firing of the said perforator, the said perforator being equipped with a receiver of such physical fields.

The analysis of pumping various fluids, primarily oil, out of wells shows that the optimization of the pumping unit operation mode, when combined with the use of a perforator, enables to create well conditions for producing the maximum possible flow rate of the fluid extracted from a formation. Of significant importance in such conditions is the possibility of performing, with the use of a well jet pumping unit, operations for creating the necessary differential pressure drawdown and shooting the perforator (i.e., performing shooting and firing works in wells, which are associated with the firing of jet perforator charges in the conditions of the optimal differential pressure drawdown).

The possibility of shooting the perforator after reaching a stable and necessary pressure drawdown enables to achieve the maximum effect of the perforator firing energy, which results in an improvement of the secondary opening-up quality and in removal of the mud particles impeding the inflow of the extracted fluid from the formation to the well. As a result, after the perforator firing the formation immediately begins kicking, and an intensive process of the formation perforation and pore clearing occurs around the wellbore. In high-yield oil- and, especially, gas-producing wells it results in an intensive pressure increase at the wellhead, as the well is filled with the formation fluid.

The jet pump operation after the firing of the perforator enables to remove the mud particles out of the well, thus preventing a reduction in the inflow from the formation to the well.

The installation of a back pressure valve enables to avoid an ejecting medium's entering into the perforations at all stages of well development, in particular at the stage of substituting another pumping means, e.g., a production pump, for the jet pumping unit. The monitoring of the well parameters in the process of the formation drainage enables to correctly determine the pump type necessary for the further well operation with maximum efficiency.

Thus, the objective of the invention—to optimize development works on subpressure wells for the purpose of extracting various fluids out of wells and, owing to it, to intensify the production of various fluids—is achieved.

PREFERRED EMBODIMENT

Figure 1:
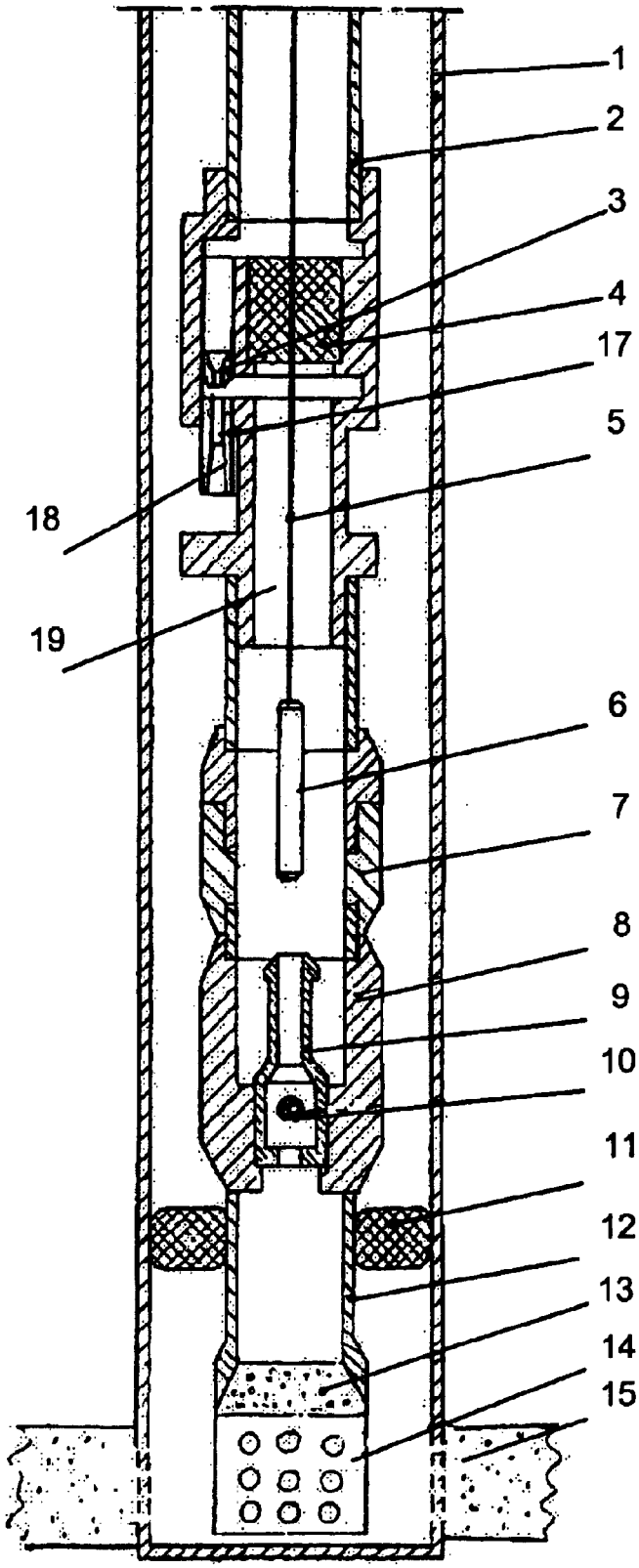
FIG. 1 shows a oil well pumping unit implementing the proposed method, at the time of the formation drainage works.
Figure 2:
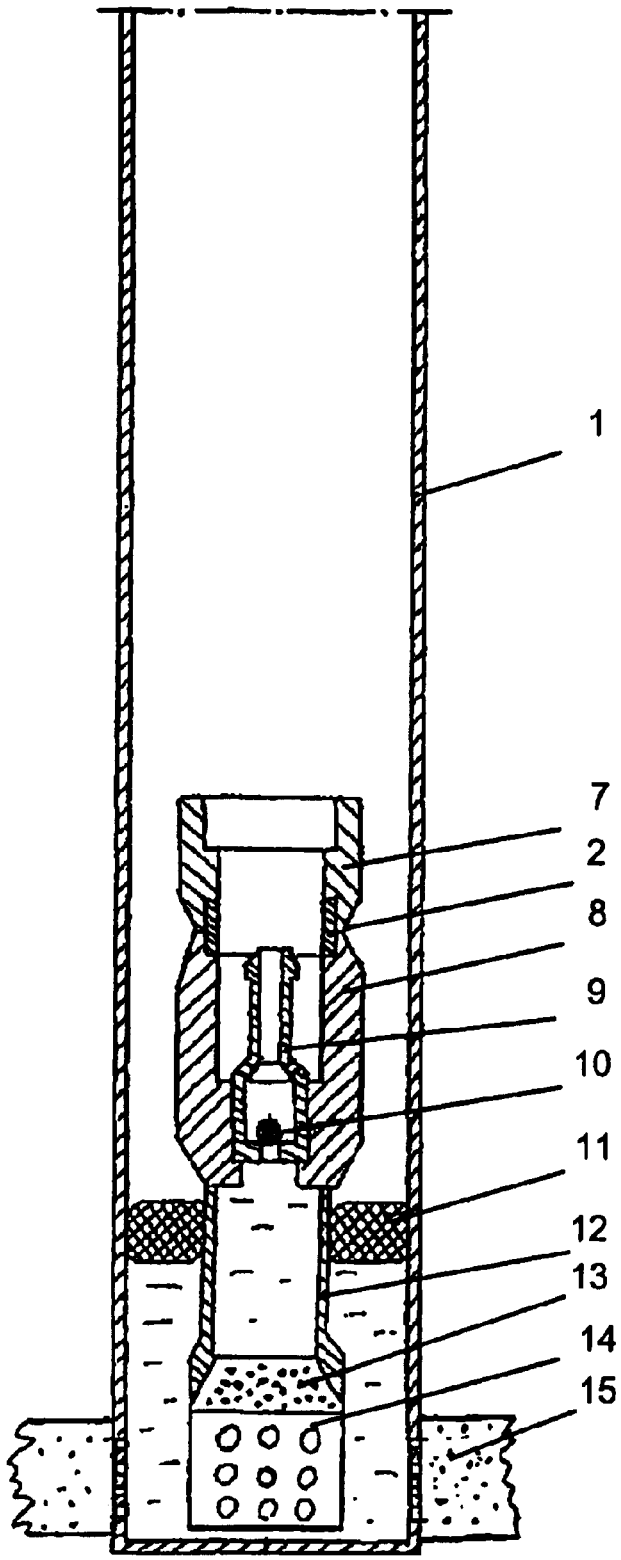
FIG. 2 shows the same unit at the time after the removal of the jet pump and the geophysical instrument out of the well.
Figure 3:
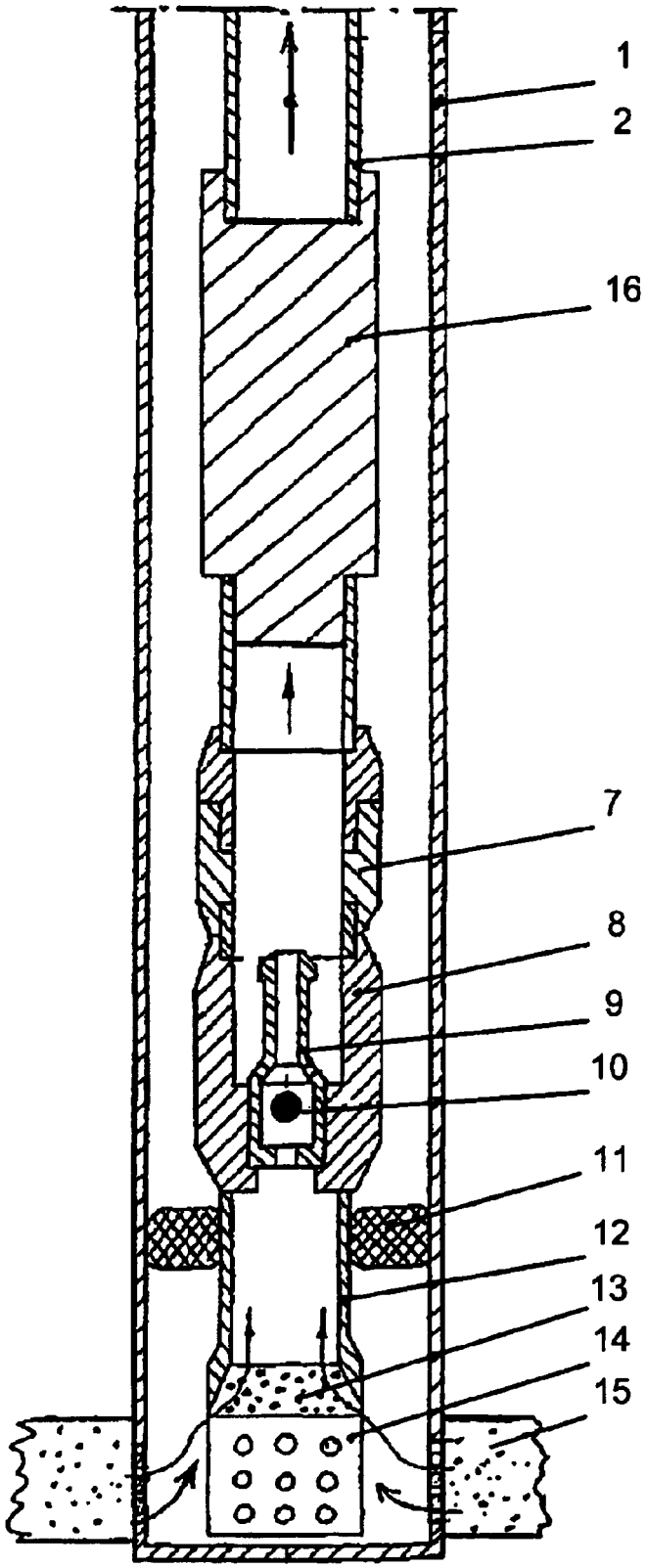
FIG. 3 shows the same unit at the time after the substitution of a pump for extracting the produced fluid out of the well for the jet pump.

The oil well pumping unit, as used for the implementation of the proposed method, comprises the production string 2 installed in the well casing 1, the jet pump 3 and the seal assembly (gate) 4 installed in the case, the well-logging cable 5 with the geophysical instrument 6 attached thereto. The production string 2 is equipped with the connecting/disconnecting insert 7; the valve assembly 8, which comprises the valve insert 9 with the back pressure valve 10, is installed below the insert 7. In the annular space of the production string 2 the packer 11 is installed, and the liner 13 with the filter 13 and the perforator 14 is installed below the packer 11 on the production string 2. The perforator 14 is placed in the area of the formation 15. The production pump 16, which is intended for pumping the extracted fluid out of the well during the well producing life, may be installed with the use of the connecting/disconnecting insert 7 above the insert 7 and over the valve 10 on the production string 2.

The described method of operating the oil well pumping unit can be implemented as follows.

The oil well pumping unit, as used for the implementation of the proposed method, comprises the production string 2 installed in the well casing 1, the jet pump 3 and the seal assembly (gate) 4 installed in the case, the well-logging cable 5 with the geophysical instrument 6 attached thereto. The production string 2 is equipped with the connecting/disconnecting insert 7; the valve assembly 8, which comprises the valve insert 9 with the back pressure valve 10, is installed below the insert 7. In the annular space of the production string 2 the packer 11 is installed, and the liner 13 with the filter 13 and the perforator 14 is installed below the packer 11 on the production string 2. The perforator 14 is placed in the area of the formation 15. The production pump 16, which is intended for pumping the extracted fluid out of the well during the well producing life, may be installed with the use of the connecting/disconnecting insert 7 above the insert 7 and over the valve 10 on the production string 2. A diffuser 18 and central channel 19 for supplying a passive medium are also provided.

INDUSTRIAL APPLICABILITY

The present invention may be used in the oil industry and in the mining industry when extracting various fluids from wells. The proposed invention, as compared to the prototype and the other known technical solutions, has a number of significant advantages, namely: the action on the well formation zone is intensified owing to the optimization of various influencing factors in subpressure wells, thus stimulating the extraction of various fluids from wells being developed or under workover operation.

What is claimed is:

1. A method of operating an oil well pumping unit, comprising:

installing a jet pump and a perforator below the said jet pump on a production string, installing a packer in an annular space of the said production string, supplying an ejecting liquid medium through the production string to a nozzle of the said jet pump, pumping of the fluid out of the well area under the said packer, and performing formation drainage by firing the said perforator, characterized by installing a geophysical instrument below the jet pump after the installation of the latter in the production string, installing a back pressure valve and a filter below the said geophysical instrument;

thereafter, supplying an ejecting medium to the nozzle of the said jet pump, measuring the pressure drawdown with the use of the said geophysical instrument, and after reaching a preset stable pressure drawdown, sending a signal to shoot the said perforator from the said geophysical instrument, the formation fluid being continuously pumped out by the said jet pump through the said filter and the said back pressure valve; and, after a stable flow of the fluid extracted from the well is established, stopping the supply of the said ejecting medium to the jet pump, removing the said geophysical instrument from the production string, disconnecting the said jet pump from the said valve and raising to the surface out of the well;

thereafter, installing a production pump above the said back pressure valve on the production string, and using the said production pump for pumping the extracted fluid out of the well.

2. An oil well jet pumping unit comprising, all of them being installed on a piping string, a packer, a back pressure valve, a jet pump having an active nozzle, a diffuser and a central channel for supplying a passive medium, a seal assembly, the said back pressure valve being installed below the said seal assembly and a geophysical instrument being installed on a well-logging cable going through the said seal assembly, characterized in that the said oil well jet pumping unit comprises a filter and a perforator, the said geophysical instrument being installed above the said back pressure valve and below the said jet pump, and the said filter and the said perforator being installed below the said back pressure valve, the said piping string is made with a connecting/disconnecting insert located above the said back pressure valve, the said geophysical instrument is equipped with a physical field source for initiating firing of the said perforator, and the said perforator is equipped with a receiver of such physical fields.

* * * * *